US011122866B2

(12) United States Patent
Chan

(10) Patent No.: US 11,122,866 B2
(45) Date of Patent: Sep. 21, 2021

(54) EYELET BUTTON AND ASSEMBLY METHOD THEREOF

(71) Applicant: Duraflex Hong Kong Limited, Hong Kong (CN)

(72) Inventor: Man Chak Chan, Hong Kong (CN)

(73) Assignee: DURAFLEX HONG KONG LIMITED, Hong Kong (CN)

( * ) Notice: Subject to any disclaimer, the term of this patent is extended or adjusted under 35 U.S.C. 154(b) by 0 days.

(21) Appl. No.: 16/857,276

(22) Filed: Apr. 24, 2020

(65) Prior Publication Data

US 2020/0375323 A1 Dec. 3, 2020

(30) Foreign Application Priority Data

May 30, 2019 (CN) ..... 201910461433.X

(51) Int. Cl.
*A44B 13/00* (2006.01)
*A44B 17/00* (2006.01)

(52) U.S. Cl.
CPC ..... *A44B 13/0058* (2013.01); *A44B 17/0011* (2013.01)

(58) Field of Classification Search
CPC ..... A44B 13/0058; A44B 17/0011
See application file for complete search history.

(56) References Cited

U.S. PATENT DOCUMENTS 1,404,014 A * 1/1922 Daniels ..... A44B 17/0011 24/663
2,622,291 A * 12/1952 Drell ..... A44B 1/28 24/109
3,643,296 A * 2/1972 Kahn ..... A44B 1/32 24/108
3,644,965 A * 2/1972 Kahn ..... A44B 1/28 24/114.05
5,456,095 A * 10/1995 Tawil ..... A44C 17/0216 24/574.1
9,516,931 B2 * 12/2016 Mencagli ..... A44B 1/32
2004/0025306 A1 * 2/2004 Coffey ..... A44B 17/0035 24/114.05
2012/0291486 A1 * 11/2012 Cardin ..... A44C 17/0216 63/15

* cited by examiner

*Primary Examiner* — David M Upchurch
(74) *Attorney, Agent, or Firm* — Collard & Roe, P.C.

(57) ABSTRACT

An eyelet button and an assembly method thereof, in which the eyelet button is formed of an eyelet button body and a base plate for fastening with the eyelet button body. The eyelet button body is formed from an eyelet tube, a body peripheral portion formed by everything at one end of the eyelet tube in an axial direction, and a plurality of inverted fasteners formed by everting at the other end of the eyelet tube in the axial direction. The base plate is formed of a base plate body, with a mounting hole with an inner wall having a plurality of protruded tooth portions. A gap is formed between two adjacent protruded tooth portions. When the eyelet tube passes through the mounting hole, the inverted fasteners pass through the gaps to rotate with the eyelet tube so as to be connected and fixed to the corresponding protruded tooth portions.

9 Claims, 6 Drawing Sheets

EYELET BUTTON AND ASSEMBLY METHOD THEREOF

CROSS REFERENCE TO RELATED APPLICATIONS

Applicant claims priority under 35 U.S.C. § 119 of Chinese Application No. 201910461433.X filed May 30, 2019, the disclosure of which is incorporated by reference.

BACKGROUND OF THE INVENTION

1. Field of the Invention

The present invention relates to the field of buttons, and in particular to an eyelet button and an assembly method thereof.

2. Description of the Related Art

Eyelet buttons are mounted on cloth of clothes, shoes, bags, etc., so that the cloth has holes for achieving breathability and water permeability, or for a shoe lace to pass through. The eyelet button is generally composed of two parts, i.e. a metal ring and a ring-shaped washer. The metal ring has a cylindrical portion and a flange portion extending radially outward from an axial end of the cylindrical portion. Furthermore, when the eyelet button is mounted to the cloth, the cylindrical portion of the metal ring passes through the cloth and is then riveted, the riveted portion of the cylindrical portion is received by the washer, and the cloth is thus kept and restricted between the washer and the flange portion of the metal ring, thereby fixing the eyelet button to the cloth.

The aforementioned eyelet button generally uses a press deformation process to fixedly mount the eyelet button on a substrate such as cloth or leather, so the eyelet button is usually made of a deformable material such as metal or plastic. When the eyelet button uses a material that cannot be deformed or has poor yield strength, it is difficult to fixedly mount the eyelet button on the substrate such as the cloth or the leather, and it is hard to exert its own function.

SUMMARY OF THE INVENTION

In view of the above technical problems, the present invention proposes an eyelet button and an assembly method thereof.

The present invention relates to an eyelet button, which comprises an eyelet button body and a base plate for fastening with the eyelet button body, wherein the eyelet button body comprises an eyelet tube, a body peripheral portion formed by everting at one end of the eyelet tube in an axial direction, and a plurality of inverted fasteners formed by everting at the other end of the eyelet tube in the axial direction. The base plate comprises a base plate body, and the base plate body is provided with a mounting hole; an inner wall of the mounting hole is formed with a plurality of protruded tooth portions in one-to-one correspondence with the plurality of inverted fasteners in a protruding manner, and a gap is formed between two adjacent protruded tooth portions. When the eyelet tube passes through the mounting hole, the plurality of inverted fasteners pass through the gaps to rotate with the eyelet tube so as to be connected and fixed to the corresponding protruded tooth portions.

A plurality of taper pins can b formed on the side of the body peripheral portion facing the eyelet tube.

In one embodiment, a protruded tooth portion is provided with a clamping groove, and a slope portion is formed on either side of the clamping groove.

In one embodiment, the mounting hole is a through hole, and an inner cross-sectional contour thereof matches an outer cross-sectional contour of the eyelet tube.

The cross section of the eyelet tube can be a polygon.

A positioning member can be formed on an outer wall of the base plate body.

The positioning member can be a lug or a recess.

The present invention also proposes an assembly method of an eyelet button, in which a fastened object is sandwiched between an eyelet button body and a base plate, and the fastened object is provided with a fixing hole, the assembly method comprising the following steps of:

step S1, providing an eyelet button, which comprises an eyelet button body and a base plate for fastening with the eyelet button body, wherein the eyelet button body comprises an eyelet tube, a body peripheral portion formed by everting at one end of the eyelet tube in an axial direction, and a plurality of inverted fasteners formed by everting at the other end of the eyelet tube in the axial direction, wherein the base plate comprises a base plate body, and the base plate body is provided with a mounting hole; and an inner wall of the mounting hole is formed with a plurality of protruded tooth portions in one-to-one correspondence with the plurality of inverted fasteners in a protruding manner, and a gap is formed between two adjacent protruded tooth portions;

step S2, the eyelet tube firstly passing through the fixing hole in the fastened object and then passing through the mounting hole, and the plurality of inverted fasteners passing through the gaps; and step S3, rotating the eyelet tube such that the plurality of inverted fasteners are rotated so as to be connected and fixed to the corresponding protruded tooth portions.

In the aforementioned assembly method of an eyelet button of the present invention, at step S3, by rotating the eyelet tube, the inverted fasteners enter clamping grooves along slope portions to achieve fastening.

The present invention constructs an eyelet button wherein the eyelet button body and the base plate are connected by a fastening structure of an inverted fastener and a clamping groove, so that the eyelet button can be fixedly connected to a material such as cloth or leather without deformation, thus exerting its own function. In addition, the present invention also provides an assembly method of an eyelet button based on the eyelet button. The eyelet button and the assembly method thereof of the present invention are ingeniously designed and have strong practicability.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

The technical problem to be solved by the present invention is that the traditional eyelet button generally uses a press deformation process to fixedly mount the eyelet button on a substrate such as cloth or leather, so the eyelet button usually uses a deformable material such as metal or plastic. When the eyelet button uses a material that cannot be deformed or has poor yield strength, an eyelet function cannot be exerted on the substrate such as the cloth or the leather. The idea proposed by the present invention on this technical problem is to construct an eyelet button, an eyelet button body and a base plate thereof are connected by a fastening structure of an inverted fastener and a clamping groove, so that the eyelet button can be fixedly connected to a material such as cloth or leather without deformation, thus exerting an eyelet function. Meanwhile, the present invention also provides an assembly method of an eyelet button correspondingly.

In order to make the technical solutions, technical purposes and technical effects of the present invention clearer so that those skilled in the art can understand and implement the present invention, the present invention will be described in further detail with reference to the drawings and particular embodiments.

Figure 1:
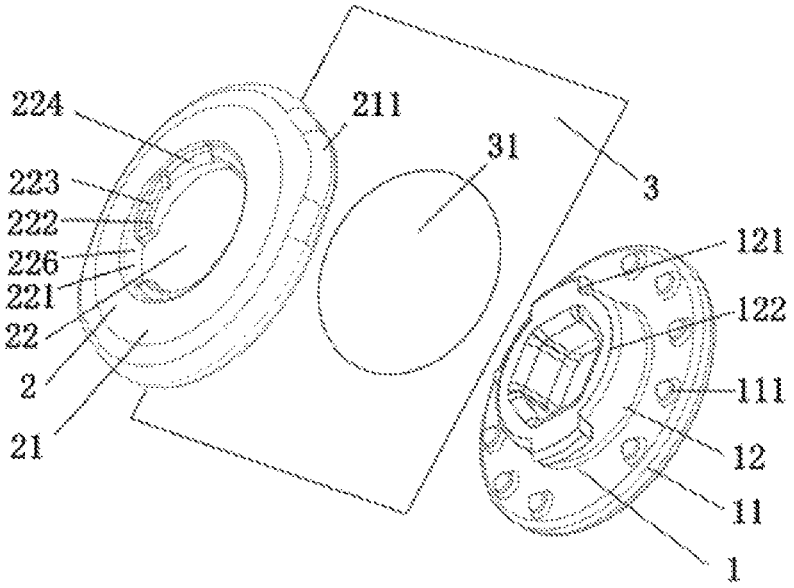
FIG. 1 is an exploded schematic diagram of an eyelet button of a preferred embodiment of the present invention.
Figure 2:
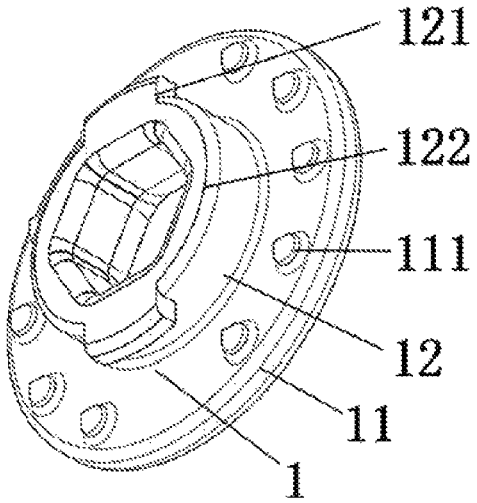
FIG. 2 is a schematic structural diagram of an eyelet button body of the eyelet button shown in FIG. 1.
Figure 3:
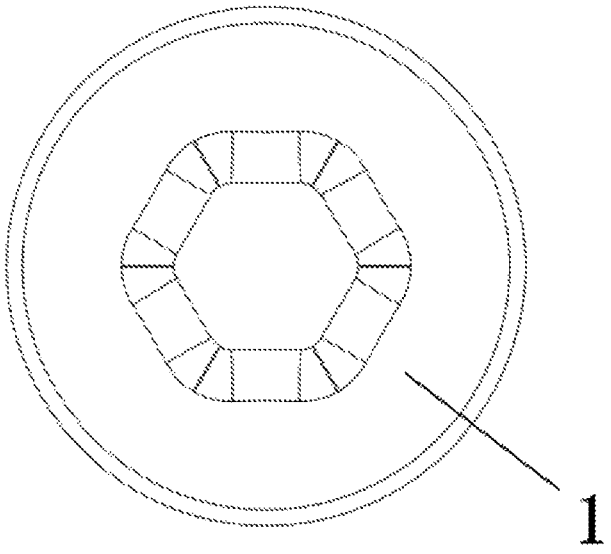
FIG. 3 is a front view of the eyelet button body of the eyelet button shown in FIG. 1.
Figure 4:
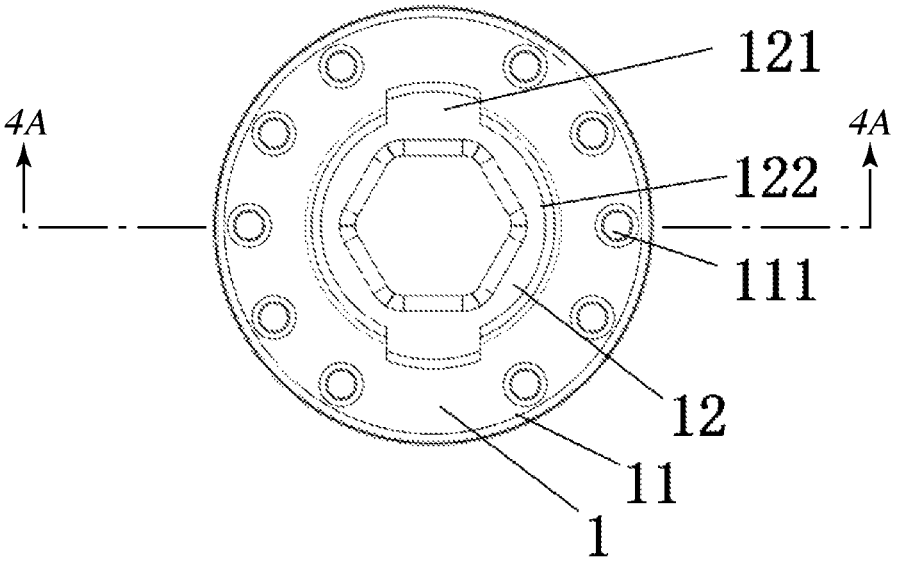
FIG. 4 is a rear view of the eyelet button body of the eyelet button shown in FIG. 1.
Figure 4A:
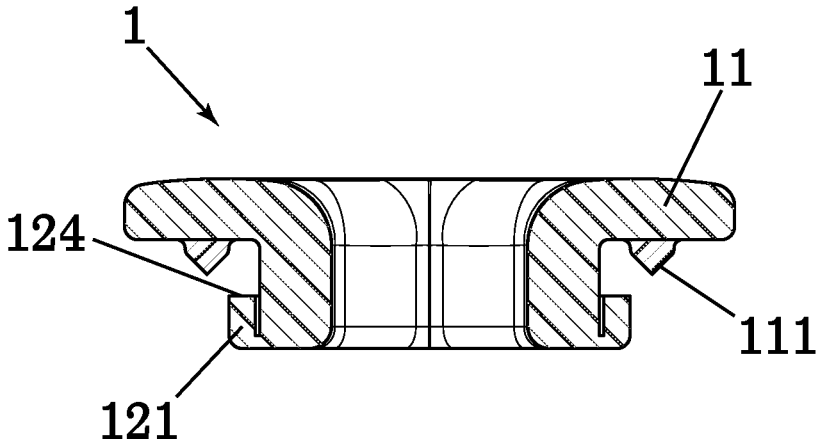
FIG. 4*a* is a cross-sectional view of the eyelet button body according to lines 5-5 of FIG. 4.
Figure 5:
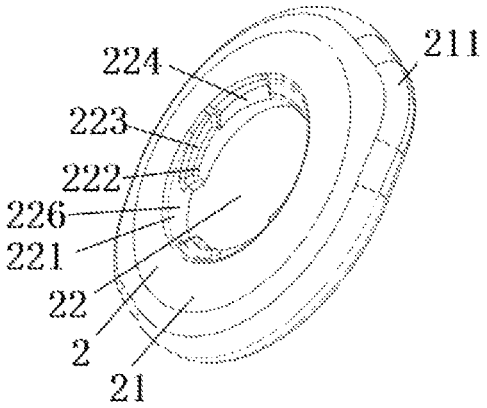
FIG. 5 is a schematic structural diagram of a base plate of the eyelet button shown in FIG. 1.
Figure 6:
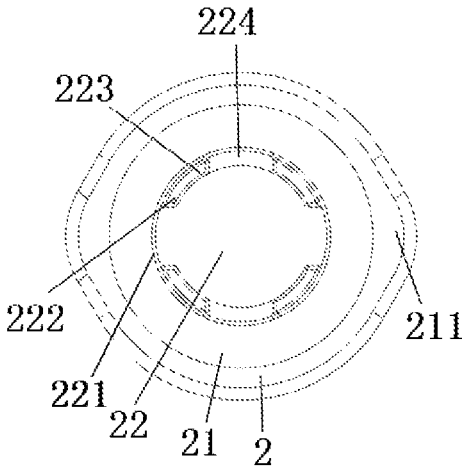
FIG. 6 is a front view of the base plate of the eyelet button shown in FIG. 1.
Figure 7:
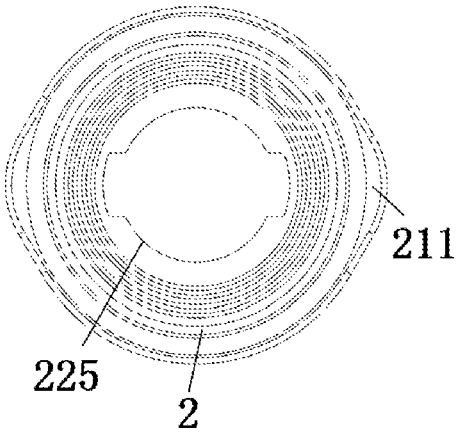
FIG. 7 is a rear view of the base plate of the eyelet button shown in FIG. 1.
Figure 8:
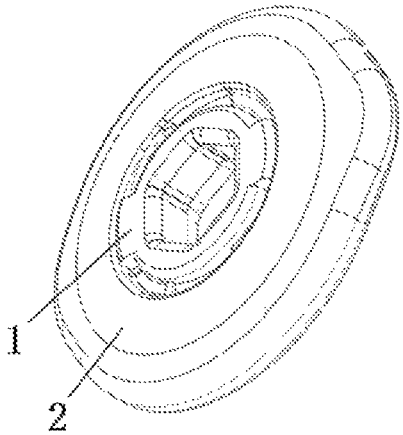
FIG. 8 is a reference diagram of use state of the eyelet button shown in FIG. 1 in a fastened state.
Figure 9:
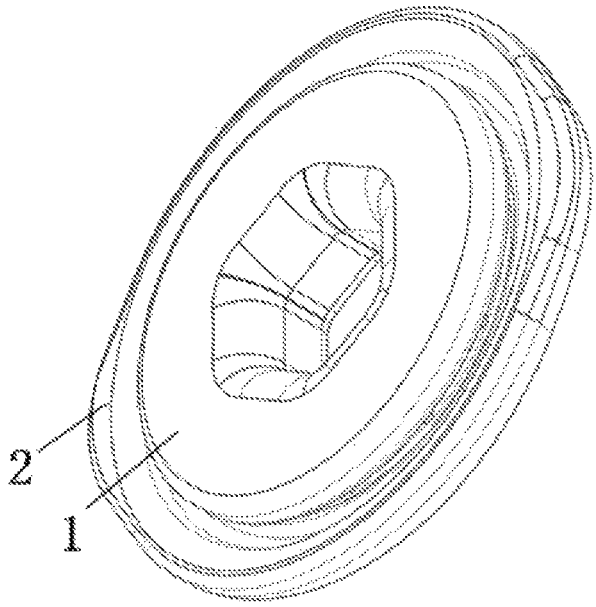
FIG. 9 is a schematic diagram of the eyelet button shown in FIG. 8 in another direction.

As shown in FIG. 1 to FIG. 9, FIG. 1 is an exploded schematic diagram of an eyelet button of a preferred embodiment of the present invention; FIG. 2 is a schematic structural diagram of an eyelet button body of the eyelet button shown in FIG. 1; FIG. 3 is a front view of the eyelet button body of the eyelet button shown in FIG. 1; FIG. 4 is a rear view of the eyelet button body of the eyelet button shown in FIG. 1; FIG. 4*a* is a cross-sectional view of the eyelet button body; FIG. 5 is a schematic structural diagram of a base plate of the eyelet button shown in FIG. 1; FIG. 6 is a front view of the base plate of the eyelet button shown in FIG. 1; FIG. 7 is a rear view of the base plate of the eyelet button shown in FIG. 1;

FIG. 8 is a reference diagram of use state of the eyelet button shown in FIG. 1 in a fastened state; and FIG. 9 is a schematic diagram of the eyelet button shown in FIG. 8 in another direction.

Specifically, the present application provides an eyelet button, which comprises an eyelet button body 1 and a base plate 2 for fastening with the eyelet button body 1. Here, the eyelet button body 1 comprises an eyelet tube 12, a body peripheral portion 11 formed at one end of the eyelet tube 12 in an axial direction, and a plurality of inverted fasteners 121 formed by everting at the other end of the eyelet tube 12 in the axial direction so that the ends 124 of fasteners 121 extend in the axial direction. The base plate 2 comprises a base plate body 21, the base plate body 21 is provided with a mounting hole 22, an inner wall 221 of the mounting hole 22 is formed with a plurality of protruded tooth portions 222 in one-to-one correspondence with the plurality of inverted fasteners 121 in a protruding manner, and a gap 226 is formed between two adjacent protruded tooth portions 222. When the eyelet tube 12 passes through the mounting hole 22, the inverted fasteners 121 pass through the gaps 226 to rotate with the eyelet tube 12 so as to be connected and fixed to the corresponding protruded tooth portions 222. With a connecting and fixing structure between the inverted fasteners 121 and the protruded tooth portions 222, the eyelet button of this embodiment can still successfully complete the fixed connection when the inverted fastener 121 and/or the protruded tooth portion 222 use a material that has poor plasticity.

As the material of the eyelet button body 1 and the base plate 2, various materials available on the market can be used, for example, a plastically deformable material such as metal and plastic, or a material with poor plasticity such as wood, ceramics, and glass.

Further, the inside of the eyelet tube 12 is a through hole. The cross section of the through hole can be of any shape, for example, the through hole can be a hexagonal hole, which facilitates inserting an Allen wrench to rotate the eyelet button body, or the through hole of the eyelet tube can be arranged as a different shape, such as a further polygon or a special shape with curves, so as to cooperate with a corresponding rotary tool to achieve the purpose of rotating the eyelet button body.

Further, in this embodiment, a plurality of taper pins 111 are formed on the side of the body peripheral portion 11 facing the eyelet tube 12. When the eyelet button is assembled, the plurality of taper pins 111 squeeze a fastened object 3 between the eyelet button body 1 and the base plate 2 to improve the friction between the eyelet button and the fastened object 3, so that the eyelet button can be more firmly fixed on the fastened object 3.

Further, the protruded tooth portion 222 is provided with a clamping groove 224, and a slope portion 223 is formed on either side of the clamping groove 224. Here, when the eyelet button body 1 and the base plate 2 are fastened, the inverted fastener 121 enters the clamping groove 224 along the slope portion 223, and at this time, the inverted fastener 121 and the clamping groove 224 are in a fastened state, so that the inverted fastener 121 cannot withdraw. The main function of the slope portion 223 is that, during the pressing and screwing process of the eyelet button body 1 and the base plate 2, the inverted fastener 121 slides along the slope portion 223, and at this time, the inverted fastener 121 can provide an axial force to the body peripheral portion 11 by the eyelet tube 12, thus making the connection of the eyelet button body 1 and the base plate 2 tighter. In this embodiment, the slope portion 223 is part of the protruded tooth portion 222, the two being integrally formed. It can be understood that, in other embodiments, the slope portion 223 can be independent of the protruded tooth portion 222.

Further, the mounting hole 22 is a through hole as a whole, and an inner cross-sectional contour 225 thereof matches an outer cross-sectional contour 122 of the eyelet tube 12. Therefore, when the eyelet button is assembled, the eyelet tube 12 and the inverted fastener 121 can smoothly pass through the mounting hole 22.

Figure 10:
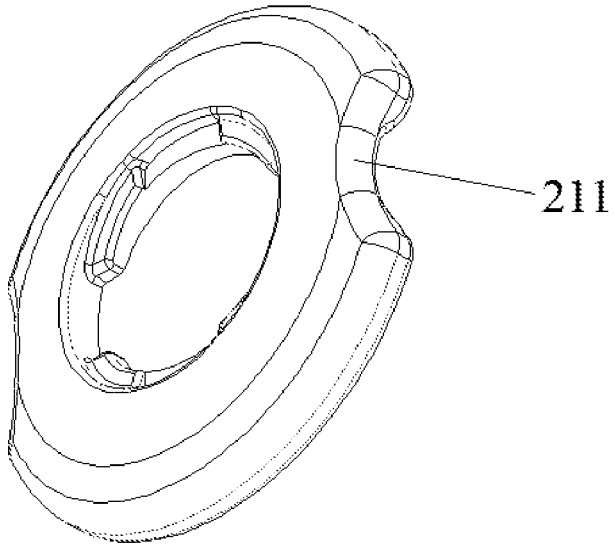
FIG. 10 is a schematic diagram of a positioning member of the base plate of the eyelet button of another embodiment of the present invention.

Further, a positioning member 211 having an orientation is formed on an outer wall of the base plate body 21. The positioning member 211 facilitates distinguishing the direction when placed in a rotation tool. In this embodiment, the positioning member 211 is a lug. In other embodiments, the positioning member 211 may also be a recess, as shown in FIG. 10. Therefore, different shapes of base plate matching type can also be used to achieve the same function. It should be particularly noted that, the number of positioning members 211 is not limited, and may be one or more. Further, the number of the protruded tooth portions 222 on the inner wall 221 of the mounting hole 22 is the same as the number of the inverted fasteners 121. Here, the number of the inverted fasteners 121 is not limited, for example, it is preferably set to about 2 to 4.

Further, an included angle between the eyelet tube 12 and the body peripheral portion 11 is arranged as a rounded corner. When the eyelet button is assembled, the stress concentration in a position where the eyelet tube 12 is in contact with the body peripheral portion 11 can be reduced, thus improving the strength of the eyelet button body 1.

Further, the present invention also proposes an assembly method of the aforementioned eyelet button, in which the fastened object 3 is sandwiched between the eyelet button body 1 and the base plate 2, and the fastened object 3 is provided with a fixing hole 31, the assembly method comprising the steps of:

Passing the eyelet tube 12 first through the fixing hole 31 in the fastened object 3 and then through the mounting hole 22, and the plurality of inverted fasteners 121 passing through the gaps 226; and rotating the eyelet tube 12 such that the plurality of inverted fasteners 121 are rotated so as to be connected and fixed to the corresponding protruded tooth portions 222. More specifically, by rotating the eyelet tube 12, the inverted fasteners 121 enter the clamping grooves 224 along the slope portions 223 to achieve fastening. In this state, the taper pins 111 on the body peripheral portion 11 press the fastened object 3 on the base plate body 21, and the body peripheral portion 11 is received inside the base plate body 21 via the fastened object 3, as shown in FIG. 8 and FIG. 9.

In the above technical solution, the rotation tool is inserted into the eyelet tube 12 of the eyelet button body 1 and cooperates with the eyelet tube 12, and then the eyelet button body 1 can be easily rotated so that the aforementioned inverted fastener 121 enters the position of the clamping groove 224 of the base plate along the slope portion 223, thus achieving the fixed connection between the eyelet button body 1 and the base plate 2.

The present invention constructs an eyelet button in which the eyelet button body and the base plate are connected by a fastening structure of an inverted fastener and a clamping groove, so that the eyelet button can be fixedly connected to a material such as cloth or leather without deformation, thus exerting its own function. In addition, the present invention also provides an assembly method of an eyelet button based on the eyelet button. The eyelet button and the assembly method thereof of the present invention are ingeniously designed and have strong practicability.

The embodiments of the present invention are described above with reference to the drawings. However, the present invention is not limited to the aforementioned particular embodiments. The aforementioned particular embodiments are merely for illustration rather than limitation. In light of the teachings of the present invention, a person of ordinary skill in the art may further use various forms without departing from the spirit and the protection scope of the claims of the present invention, and these forms all fall within the protection scope of the present invention.

What is claimed is:

1. An eyelet button comprising:

an eyelet button body comprising an eyelet tube, a body peripheral portion formed at one end of the eyelet tube in an axial direction, and a plurality of inverted fasteners formed by everting at the other end of the eyelet tube in the axial direction, wherein the inverted fasteners are in the form of hooks having end portions that extend in the axial direction, and a base plate configured for fastening with the eyelet button body, the base plate comprising a base plate body provided with a mounting hole, wherein an inner wall of the mounting hole is formed with a plurality of protruded tooth portions extending radially into the mounting hole in one-to-one correspondence with the plurality of inverted fasteners in a protruding manner, and a gap is formed between two adjacent protruded tooth portions, wherein the eyelet button body is configured to be fastened with the base plate by passing the eyelet tube through the mounting hole so that the plurality of inverted fasteners pass through the gaps, and rotating the eyelet tube to connect and fix the inverted fasteners to the corresponding protruded tooth portions.

2. The eyelet button according to claim 1, wherein a plurality of taper pins are formed on a side of the body peripheral portion facing the eyelet tube.

3. The eyelet button according to claim 1, wherein each protruded tooth portion is provided with a clamping groove, and wherein a slope portion is formed on either side of the clamping groove.

4. The eyelet button according to claim 1, wherein the mounting hole is a through hole, and wherein an inner cross-sectional contour thereof matches an outer cross-sectional contour of the eyelet tube.

5. The eyelet button according to claim 1, wherein a cross-section of the eyelet tube is a polygon.

6. The eyelet button according to claim 1, wherein a positioning member is formed on an outer wall of the base plate body.

7. The eyelet button according to claim 6, wherein the positioning member is a lug or a recess.

8. A method for assembling an eyelet button, in which a fastened object is sandwiched between an eyelet button body and a base plate, and the fastened object is provided with a fixing hole, the assembly method comprising the following steps:

providing the eyelet button, which comprises the eyelet button body and the base plate for fastening with the eyelet button body, wherein the eyelet button body comprises an eyelet tube, a body peripheral portion formed by everting at one end of the eyelet tube in an axial direction, and a plurality of inverted fasteners formed by everting at the other end of the eyelet tube to form hooks having end portions extending in the axial direction, and the base plate comprises a base plate body provided with a mounting hole having an inner walls formed with a plurality of protruded tooth portions extending radially into the mounting hole in one-to-one correspondence with the plurality of inverted fasteners in a protruding manner, wherein a gap is formed between two adjacent protruded tooth portions;

passing the eyelet tube first through the fixing hole in the fastened object and then through the mounting hole, and passing the plurality of inverted fasteners through the gaps; and rotating the eyelet tube such that the plurality of inverted fasteners are rotated so as to be connected and fixed to the corresponding protruded tooth portions.

9. The method according to claim 8, wherein during the step of rotating, the inverted fasteners enter clamping grooves along slope portions to achieve fastening.

* * * * *